US006914671B2

(12) United States Patent
Focke et al.

(10) Patent No.: US 6,914,671 B2
(45) Date of Patent: Jul. 5, 2005

(54) METHOD AND APPARATUS FOR THE INSPECTION OF OBJECTS

(75) Inventors: Heinz Focke, deceased, late of Verden (DE); by Jurgen Focke, legal representative, Verden (DE); by Doris Focke, legal representative, Verden (DE); Michael Czarnotta, Bremen (DE); Dietrich Below, Bulstedt (DE)

(73) Assignee: Focke & Co. (GmbH) (DE)

( * ) Notice: Subject to any disclaimer, the term of this patent is extended or adjusted under 35 U.S.C. 154(b) by 0 days.

(21) Appl. No.: 10/689,416

(22) Filed: Oct. 20, 2003

(65) Prior Publication Data

US 2004/0141174 A1 Jul. 22, 2004

Related U.S. Application Data

(63) Continuation-in-part of application No. 09/954,768, filed on Sep. 17, 2001, now abandoned.

(30) Foreign Application Priority Data

Sep. 18, 2000 (DE) ..... 100 46 401

(51) Int. Cl.[7] ..... G01N 21/00
(52) U.S. Cl. ..... 356/237.1
(58) Field of Search ..... 356/237.1–237.9, 356/376, 394, 398; 250/208.1, 223 R, 221, 559.04; 53/136.1–136.4, 234, 415, 508, 575; 156/64, 350, 351, 378

(56) References Cited

U.S. PATENT DOCUMENTS

| | | | | |
|---|---|---|---|---|
| 3,750,676 A | * | 8/1973 | Kruse et al. | 53/456 |
| 4,738,073 A | | 4/1988 | Mattei et al. | |
| 4,972,494 A | | 11/1990 | White | |
| 4,999,967 A | * | 3/1991 | Hoffmann | 53/64 |
| 5,086,790 A | * | 2/1992 | Greene, Jr. | 131/96 |
| 5,841,881 A | | 11/1998 | Iwakawa et al. | |
| 5,877,506 A | | 3/1999 | Focke et al. | |
| 6,564,527 B1 | | 5/2003 | Focke et al. | |

FOREIGN PATENT DOCUMENTS

| | | |
|---|---|---|
| DE | 195 35 038 A1 | 3/1996 |
| DE | 36 35 722 C2 | 1/1997 |
| DE | 198 39 852 A | 9/1999 |
| DE | 188 94 671 | 8/2000 |
| DE | 199 04 671 A1 | 8/2000 |
| EP | 0 854 090 A | 7/1998 |
| EP | 0 902 275 A | 3/1999 |
| EP | 0 820 617 B1 | 5/2000 |
| WO | WO 00 22826 A | 4/2000 |
| WO | WO 00/47947 | 8/2000 |

* cited by examiner

*Primary Examiner*—Tu T. Nguyen
(74) *Attorney, Agent, or Firm*—Todd Deveau; Thomas, Kayden, Horstemeyer & Risley LLP

(57) ABSTRACT

The invention relates to a method and apparatus for the inspection of objects, such as cigarette packs (10), with respect to the proper positioning of blanks placed upon them, such as band strips (12), by means of an inspection means (39). Known inspection means have the disadvantage that they are very expensive. The invention provides a cost-efficient alternative. To this end, blanks are illuminated laterally at one or more border edges (22) while the inspection means (39) scans the blank (12) at an essentially frontal aspect.

11 Claims, 5 Drawing Sheets

METHOD AND APPARATUS FOR THE INSPECTION OF OBJECTS

This application is a continuation-in-part of U.S. application Ser. No. 09/954,768, filed Sep. 17, 2001, now abandoned, which claims priority to German application 100 46 401.7, dated 18 Sep. 2000.

FIELD OF THE INVENTION

The invention relates to a method for the inspection of objects, such as packs, with respect to the proper positioning of blanks placed on them, such as labels, in particular for inspecting the proper arrangement of band strips on cigarette packs, with the objects being moved past an inspection means and illuminated by one or more illuminating means in the region of the inspection means and with the positioning being ascertained by scanning the border edges of the blank.

Furthermore, the invention relates to an apparatus for the inspection of such objects by means of an inspection means and one or more illumination means in the region of a conveying path of the objects, with the inspection means ascertaining the positioning by using the border edges of the blank.

BACKGROUND OF THE INVENTION

After being manufactured and filled, packs are provided with a variety of labels, revenue stamps, coupons or the like, which are attached to the outer side of the pack, e.g. by adhesive bonding. It is crucial that the blank is attached in a correct position. This is particularly important for cigarette packs which are provided with a revenue stamp or closure strip. A skewed position is undesirable.

The inspection of blanks by means of the laser triangulation method is known as disclosed, for instance, by DE 199 04 671 A1. However, this requires the use of complex and costly laser triangulation measuring systems.

SUMMARY OF THE INVENTION

The invention is therefore based on the problem of achieving a more cost-efficient manner for inspecting the surface position of attached blanks.

To solve this problem, the method according to the invention is characterized in that the blank is illuminated laterally at one or more of its border edges while the inspection means scans the blank from an essentially frontal aspect. An apparatus according to the invention is characterized in that the main illumination device of each illumination means is directed at one or more border edges of the blank and that the main line of sight of the inspection means is directed at the blank from an essentially frontal aspect.

The invention is based on the knowledge that even if a blank has the same basic color and brightness as the surrounding pack, surprisingly, recognition of the border edges of the blank is still possible if the border edges are laterally illuminated offset to the inspection means. Hitherto it has been assumed that systems based on pattern recognition require a distinct contrast between the blank to be tested and the ambient pack surface. But the invention has discerned that it is possible to achieve a reliable inspection of position even under such difficult optical circumstances as long as the border edges of the blank are subjected to intensive illumination, in particular more intensive than the flat-surface front of a blank. This applies to rough-cut edges as well as to pre-stamped and solid-color blanks.

In conjunction with the invention, the term blank is understood to mean any type of planar material lying on a pack, such as revenue stamps, labels, coupons and the like, but also blanks of the pack itself, such as the wrapper placed around soft-cup packs, for instance.

BRIEF DESCRIPTION OF THE DRAWINGS

Further special features of the pack are disclosed in the subclaims as well as in the exemplary embodiment as detailed in the drawing, which shows:

DETAILED DESCRIPTION OF A PREFERRED EMBODIMENT

Figure 1:
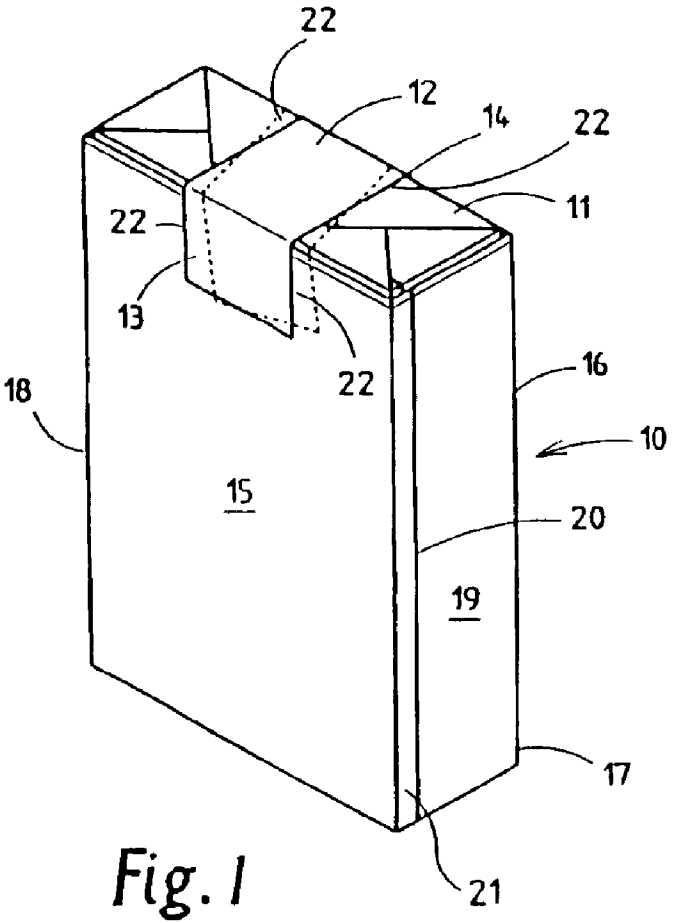
FIG. 1 a cigarette pack in perspective view.

FIG. 1 shows a cigarette pack 10 of the soft-cup type having the format of a rectangular cube. Located at an upper end face 11 of the pack 10 is a elongate, rectangular band strip 12, whose legs 13, 14 partially cover a front wall 15 and rear wall 16 of the pack 10.

After the cigarette pack 10 is completed, the band strip 12 is attached to it and held in place by adhesive bonding. In the process, it is possible that in some cases the band strip 12 is attached in a skewed position, as indicated by the dashed line in the drawing. Such skewed positions are identified on the basis of the border edges 22 of the band strip 12. Those cigarette packs 10 having an improperly positioned band strip 12 are to be identified as such and singled out.

However, the invention is also intended to recognize other blank edges and their correct formation. For example, the cigarette pack is surrounded by a wrapper 17 which encompasses the four sides of the pack 10, namely front wall 15, rear wall 16 and side walls 18 and 19. In the region of the side wall 19 a border edge 20 of the wrapper 17 overlaps a first region of the wrapper 17. Such a border edge 20 can also be inspected by the invention.

Figure 2:
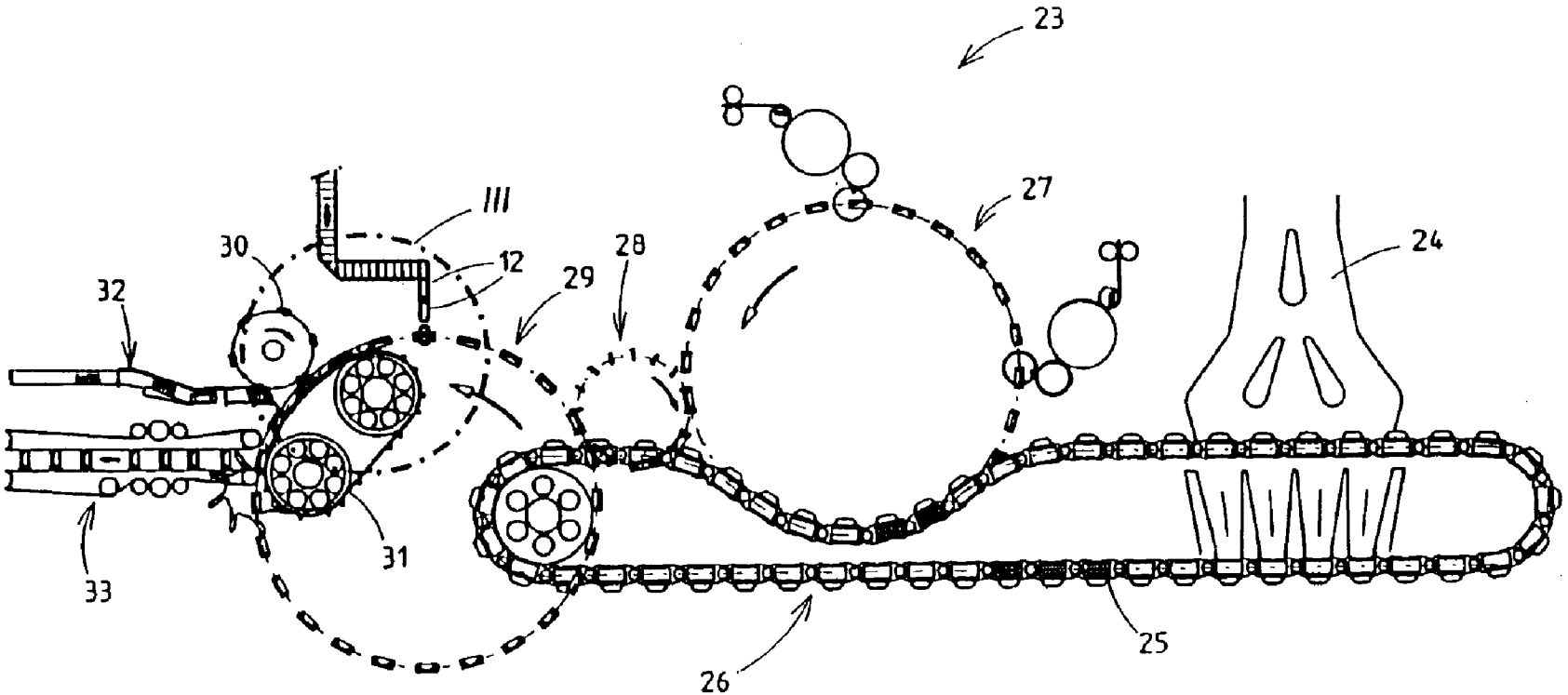
FIG. 2 partial view of a packaging machine in a simplified projection.

FIG. 2 shows the basic constructive design of one part of a packaging machine 23 for the manufacture of cigarette packs. Cigarette formations 25 taken from a cigarette store 24 are fed via a pocket chain 26 to a folding turret 27, which wraps a pack blanks around each cigarette formation. The only partially finished cigarette packs are conveyed by an intermediate turret 28 to a drying turret 29, in the region of which band strips are attached in the manner described in DE 196 47 670 A1, which is incorporated by reference as if fully set forth herein.

The packs are transferred by means of an auxiliary conveyor 30 and a belt conveyor 31 to a faulty pack conveyor 32, which sorts out faulty packs. Packs which are not sorted out are conveyed on to a discharge conveyor 33, which sends the individual packs on to the further packaging process.

The inspection of the attached band strips occurs in the region of band strip attachment to the packs 10 located in the drying turret 29.

Figure 3:
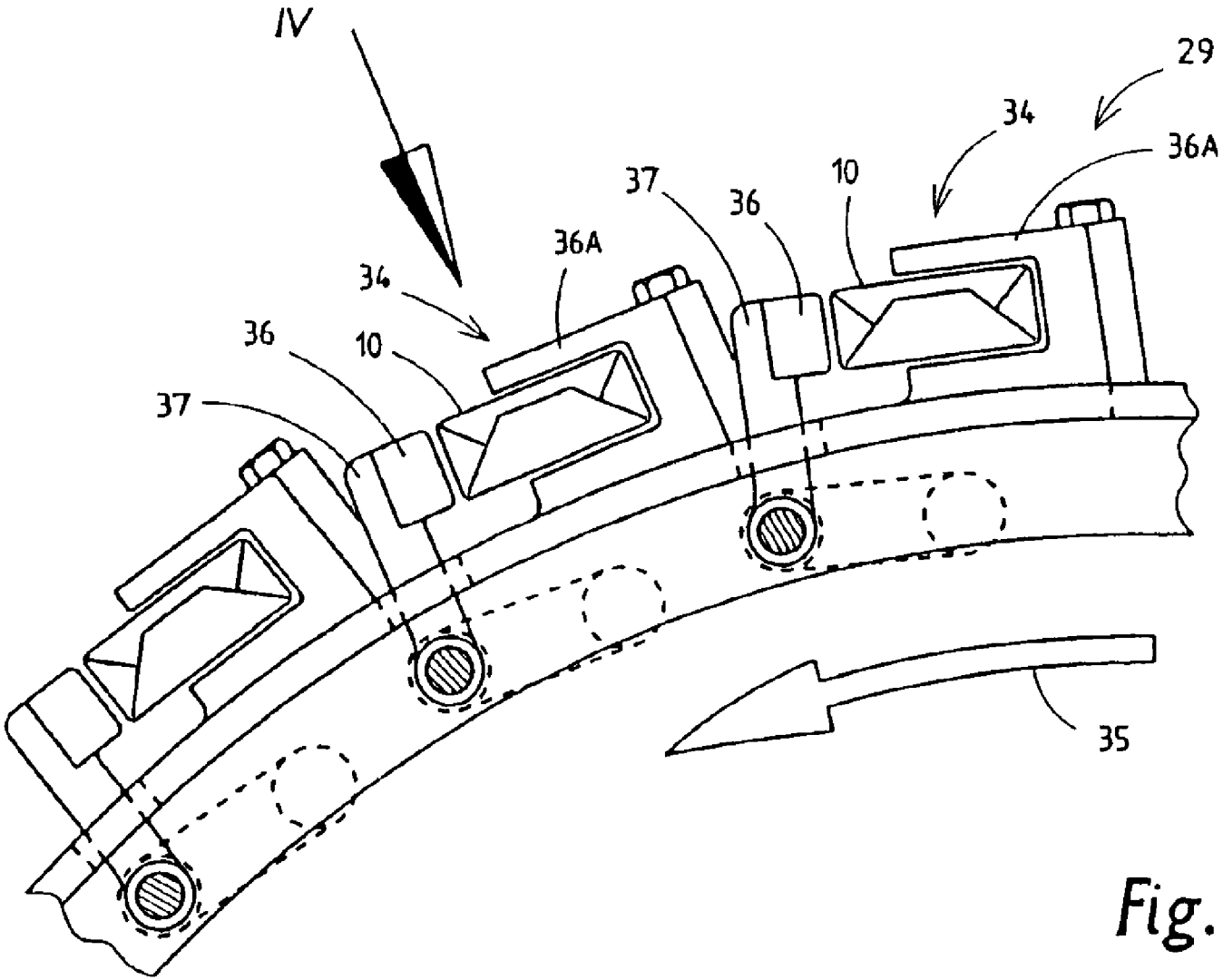
FIG. 3 a circumferential section of a drying turret of the packaging machine pursuant to FIG. 2, on enlarged scale, FIG. 4 a plan view of an inspection area of the drying turret corresponding to a section IV of FIG. 3, FIG. 5 an enlarged section along line V in FIG. 4, FIG. 6 an inspection means with illuminating means in a view along the sectional plane VI—VI in FIG. 5, FIG. 7 end view of a cigarette pack located in the drying turret in a view according to sectional plane VII—VII in FIG. 5.

FIG. 3 shows an enlarged section of the drying turret 29 indicated by the dot-dash line III in FIG. 2. Cigarette packs 10 are transported in so-called pockets 34 of the drying turret 29 along the conveying path 35. A pack 10 is guided in the pocket 34 by a pocket profile section 36A on one hand and by a lateral guide 36 on the other. The lateral guide 36 is arranged on a pivotable lever 37.

Figure 4:
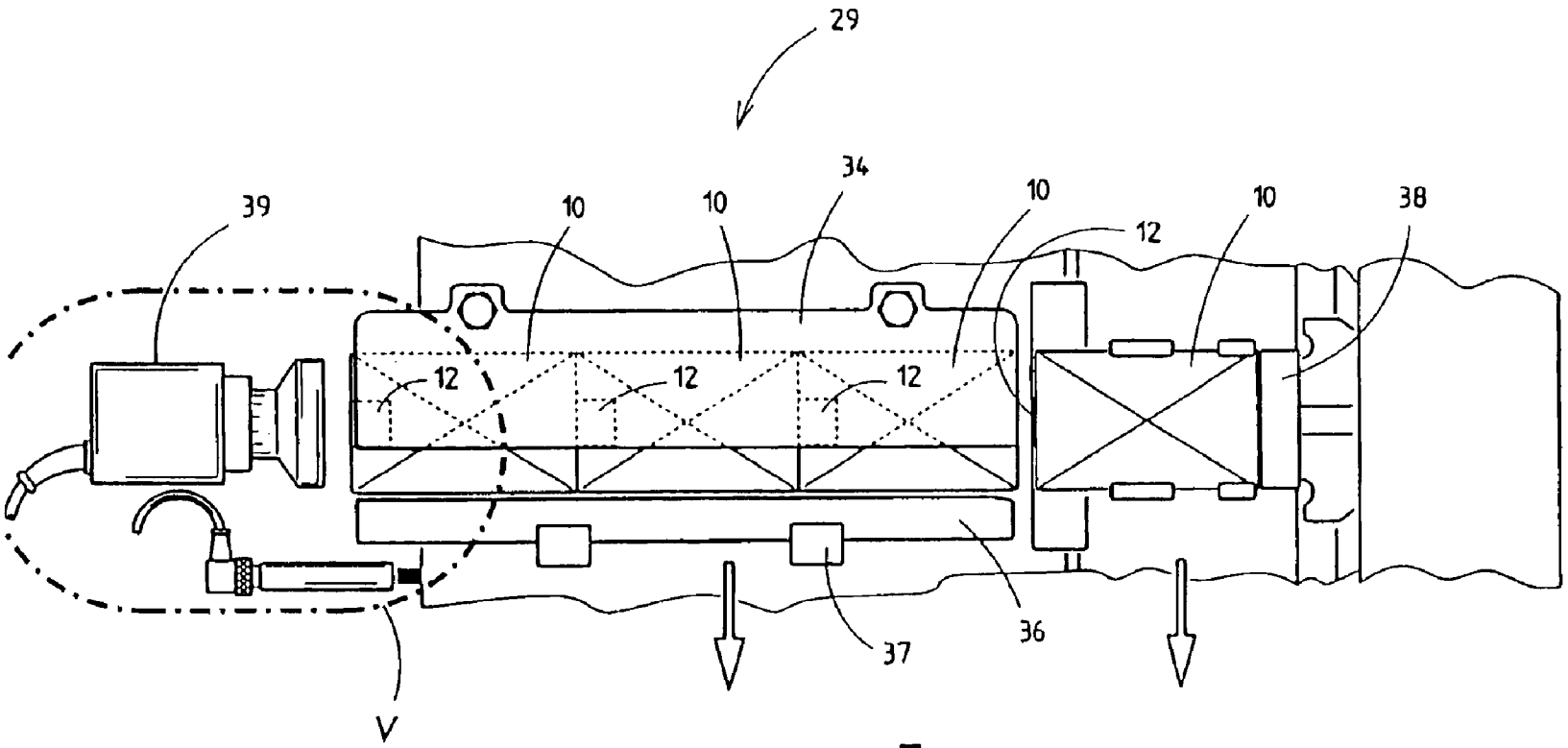

FIG. 4 shows a plan view of an inspection region of the drying turret according to the line of sight IV shown in FIG. 3. Cigarette packs 10 are pushed by a slide 38 into the elongate pockets 34, each of which can accommodate three cigarette packs 10, for example. The cigarette packs 10 are pushed into the pocket 34 so that the band strip is located on an end facing the inspection means 39.

Figure 5:
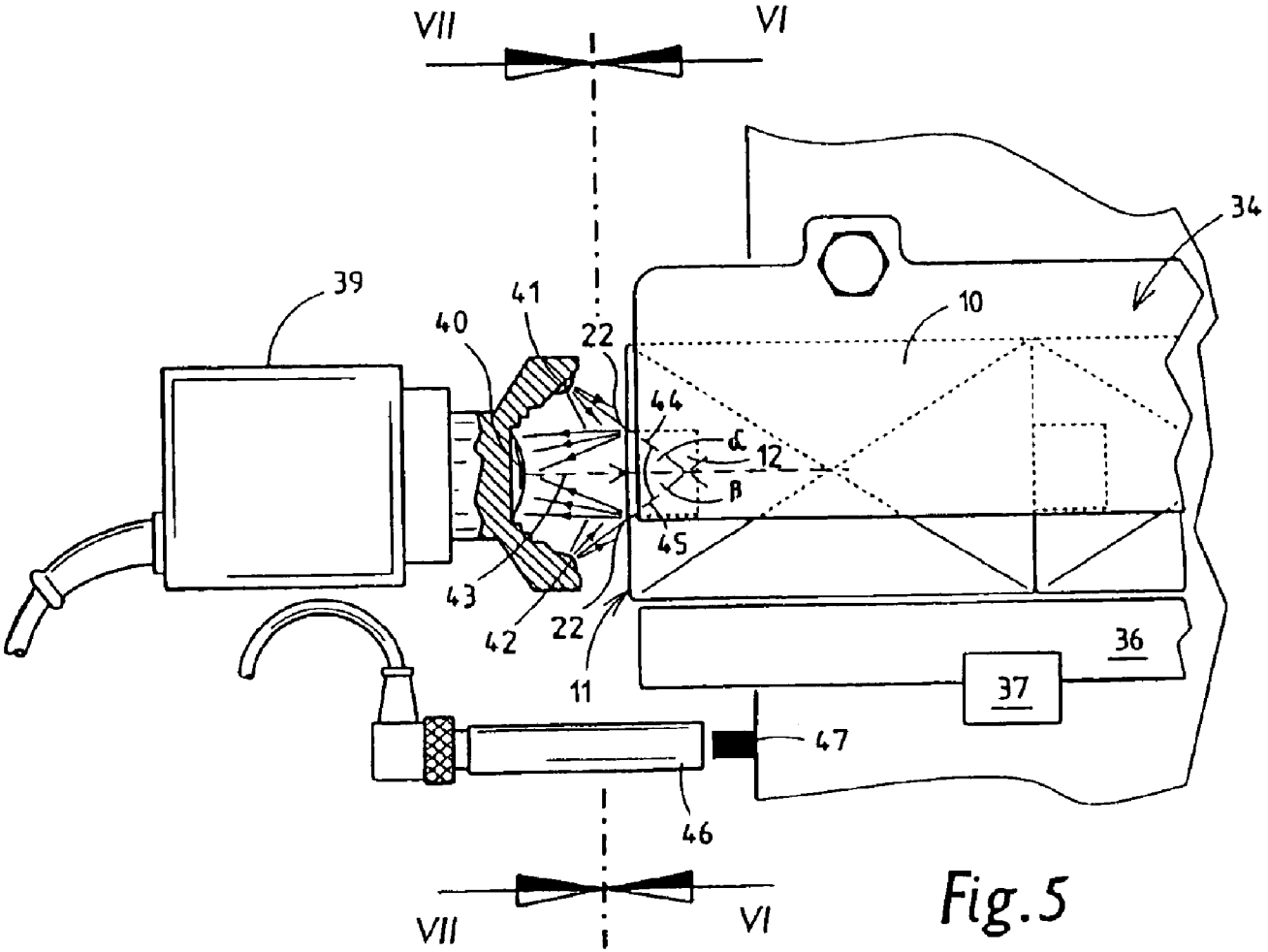

FIG. 5 shows the details of the inspection means 39 indicated inside the dot-dash outline in FIG. 4. The inspection means 39 comprises a lens 40, in particular one incorporating a lens-diaphragm system. Arranged in the region of the lens 40 are illumination means 41, 42.

While the main line of sight 43 of the inspection means 39 is frontally directed onto the region of the band strip 12 attached to the end face 11 of the cigarette pack 10, the main directions of illumination 44, 45 of the illumination means 41, 42 are primarily directed at the border edges 22 in the region of the end face 11 of the cigarette pack 10. The main line of sight 43 and the main direction of illumination 44 and 45 intersect at the angles $\alpha$ and $\beta$, respectively. The angles $\alpha$ and $\beta$ lie within a range of 45° to 90°, preferably in the range of 70° to 80°. This angular range yields the optimum light quality as reflected by the border edges 22 and received by the inspection means 39 after the light has been beamed by the illumination means at the border edges 22. Furthermore, the choice of the angle $\alpha$, $\beta$ in the aforementioned regions has the effect that the light reflected from the front of the band strip onto the inspection means 39 has a surface intensity which is less than the light reflected by the border edges 22. Consequently, the border edges 22 appear significantly brighter than the planar band strip 12 attached to the end face 11 of the cigarette pack 10. By means of this special manner of illumination, even solid-color band strips or other blanks can be reliably recognized by the inspection means 39 even against a background of the same color and brightness.

A trigger sensor 46 detects a reference position of the pocket 34 on the basis of a reference point 47 or a metal pin, arranged in the region of each pocket 34, which actuates an initiator of the trigger sensor 46. The trigger sensor then generates a trigger signal which causes a snapshot to be made by the inspection means 39 or by the camera. Furthermore, the trigger signal also switches on the illumination means 41, 42, which in each case can be turned on only temporarily, in particular in pulsed-mode operation, and then turned off again.

Instead of sensing the said metal pin at the reference point 47, the trigger sensor 46 can sense, for example, predetermined edges of the drying turret 29, or, for example as an optical sensor, scan a toothed disk located on the shaft of the turret. Consequently, the purpose of the trigger sensor is to detect a particular, precisely determined position of a cigarette pack 10 in a pocket 34 so that the inspection means can make snapshots of cigarette packs at positions which can be compared to one another.

Figure 6:
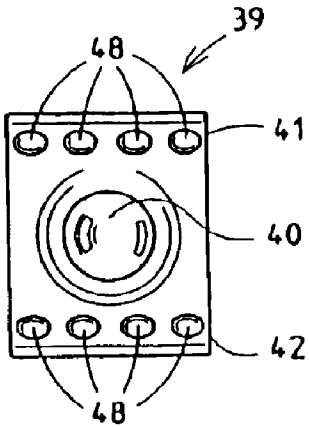

FIG. 6 shows the inspection means 39 in a view according to sectional plane VI—VI from FIG. 5, including the illumination means 41, 42, which comprise a row of white-light diodes 48.

The inspection means 39 includes preferably an electronic camera, in particular a CCD camera, with which regions to be inspected as predetermined by position and size can be selected and evaluated according to differences in brightness.

Figure 7:
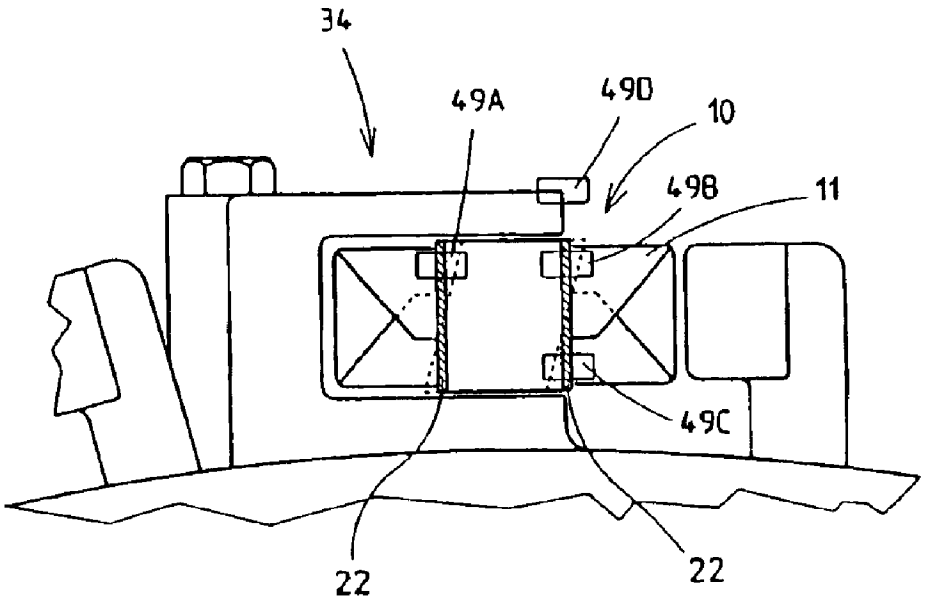

FIG. 7 shows evaluation windows 49A–D as placed as an image taken by the inspection means 39 of the end face 11 of a cigarette pack 10 located in a pocket 34. Three evaluation windows 49A–C are placed on the border edges 22 of the band strip 12. Since the border edges 22 are portrayed as bright lines, in particular as lines brighter than their background, a contrast evaluation within the evaluation windows 49A–C makes it possible to ascertain the precise position of the band strip 12 on the end face 11. In particular, any deviation of the band strip 12 from the middle of the end face 11 and any skewed position of the band strip 12 can be identified. A further evaluation window 49D is directed at a reference position of the pocket 34. This reference position of the pocket 34 is required in order to ascertain whether the band strip is indeed located at the center of the end face 11 of the cigarette pack 10. Furthermore, the arrangement of the evaluation windows makes it possible to identify the width of the band strip in that two respective evaluation windows 49A and 49B or 49C are directed at two opposite border edges 22.

Whenever the positioning of a blank is detected as being faulty—be it a band strip, a label, a coupon or a wrapper—the evaluation unit connected to the inspection means generates a rejection signal, which causes the pack in question to be eliminated by the faulty pack conveyor 32. In this way, the invention achieves a cost-efficient inspection of packs, thus increasing productivity to a considerable degree.

We claim:

1. Apparatus for the production of cigarette packs across whose respective end face a band strip attached to the pack extends, said apparatus having a folding turret, in which a cigarette formation including a plurality of cigarettes is wrapped in a pack blank to form cigarette packs and a drying turret in which glue surfaces or glue beads of the cigarette packs are dried, comprising:

a. pockets arranged along the circumference of said drying turret, the pockets having opposed open sides, b. the pockets configured to receive at one open side thereof said cigarette packs to be dried, and c. an inspection means arranged in the region of the path of movement of said drying turret for checking the correct positioning of said band strip on said cigarette packs, d. the inspection means arranged at the open side of the pockets opposite the open side in which said cigarette packs are received, e. the main line of sight of the inspection means being directed at the region of said band strip attached to said end face of said cigarette packs.

2. Apparatus according to claim 1, further comprising a faulty pack conveyor arranged downstream of said drying turret, by means of the faulty pack conveyor cigarette packs identified by the inspection means as faulty can be sorted out.

3. Apparatus according to claim 1, wherein the inspection means has an electronic camera with a lens and illumination means.

4. Apparatus according to claim 1 further including a trigger sensor, which on the basis of reference points of the drying turret detects reference positions of each of the pockets in which the checking process of the inspection means is to be executed, the trigger sensor generating a trigger signal upon detection of the respective reference position, thereby initiating the process for checking for the correct positioning of the band strip.

5. Apparatus according to claim 4, wherein a metal pin is provided as a reference point and is arranged on each of the pockets of said drying turret.

6. Apparatus for the production of cigarette packs across whose respective end face a band strip attached to the pack extends, said apparatus having a folding turret, in which a cigarette formation including a plurality of cigarettes is wrapped in a pack blank to form cigarette packs and a drying turret in which glue surfaces or glue beads of the cigarette packs are dried, comprising:

a. pockets arranged along the circumference of said drying turret, the pockets having opposed open sides, b. the pockets configured to receive at one open side thereof said cigarette packs to be dried, and expel finished cigarette packs out of the opposite open side thereof, c. a dispenser for band strips and a band strip positioning device, arranged at the circumferential region of said drying turret, d. the band strip positioning device holding a band strip in place such that the band strip can be taken along by said end face of said cigarette packs lying against said end face, each time one of said cigarette packs is inserted into one of the pockets, and e. an inspection means arranged in the region of the path of movement of said drying turret for checking the correct positioning of said band strip on said cigarette pack, f. the inspection means arranged at the open side of the pockets from which the finished cigarette packs are expelled, g. the main line of sight of the inspection means being directed at the region of said band strip attached to said end face of said cigarette packs while the inspection means checking for the correct positioning of said band strip.

7. Apparatus according to claim 6, further comprising a faulty pack conveyor arranged downstream of said drying turret, by means of the faulty pack conveyor cigarette packs identified by the inspection means as faulty can be sorted out.

8. Apparatus according to claim 6, wherein the inspection means has an electronic camera with a lens and illumination means.

9. Apparatus according to claim 6 further including a trigger sensor, which on the basis of reference points of the drying turret detects reference position of each of the pockets in which the checking process of the inspection means is to be executed, the trigger sensor generating a trigger signal upon detection of the respective reference position, thereby initiating the process for checking for the correct positioning of the band strip.

10. Apparatus according to claim 9, wherein a metal pin is provided as a reference point and is arranged on each of the pockets of said drying turret.

11. Apparatus according to claim 6, wherein the pockets are axis-parallel pockets.

* * * * *